US006487783B1

(12) United States Patent
Thomas, Jr.

(10) Patent No.: US 6,487,783 B1
(45) Date of Patent: Dec. 3, 2002

(54) LASER GUIDED CHALK LINE APPARATUS

(76) Inventor: Thomas A. Thomas, Jr., 10295 NW. 46 St., Sunrise, FL (US) 33351

( * ) Notice: Subject to any disclaimer, the term of this patent is extended or adjusted under 35 U.S.C. 154(b) by 0 days.

(21) Appl. No.: 09/863,605

(22) Filed: May 24, 2001

(51) Int. Cl.[7] ..... B44D 3/38
(52) U.S. Cl. ..... 33/414; 33/DIG. 21; 33/286
(58) Field of Search ..... 33/1 G, 1 LE, 33/227, 272, 273, 275 R, 286, 293, 351, 352, 354, 413, 414, DIG. 21

(56) References Cited

U.S. PATENT DOCUMENTS

| | | | | | |
|---|---|---|---|---|---|
| 3,857,639 | A | * | 12/1974 | Mason | 33/293 |
| 3,858,326 | A | * | 1/1975 | Hurd | 33/273 |
| 4,111,564 | A | | 9/1978 | Trice, Jr. | |
| 4,697,349 | A | * | 10/1987 | Lee | 33/414 |
| 5,163,230 | A | * | 11/1992 | Gast | 33/414 |
| 5,594,993 | A | | 1/1997 | Tager et al. | 33/DIG. 21 |
| 5,784,793 | A | * | 7/1998 | Rando | 33/227 |
| 5,829,147 | A | * | 11/1998 | Kousek et al. | 33/293 |
| 6,202,312 | B1 | | 3/2001 | Rando | 33/286 |
| 6,209,219 | B1 | | 4/2001 | Wakefield et al. | 33/DIG. 21 |
| 6,240,649 | B1 | * | 6/2001 | McElroy | 33/286 |

* cited by examiner

*Primary Examiner*—G. Bradley Bennett
(74) *Attorney, Agent, or Firm*—Alvin S. Blum

(57) ABSTRACT

A laser guided chalk line apparatus enables a single operator to set down a base with laser emitter and direct the beam in a preset direction. A free end of a chalk cord is attached to the base, and the special chalk cord reel attached to the chalk line is positioned in alignment with the light beam with the aid of a laser target on the reel. The chalk cord is then snapped against the surface to be marked with assurance that the line so marked will be accurately positioned..

19 Claims, 2 Drawing Sheets

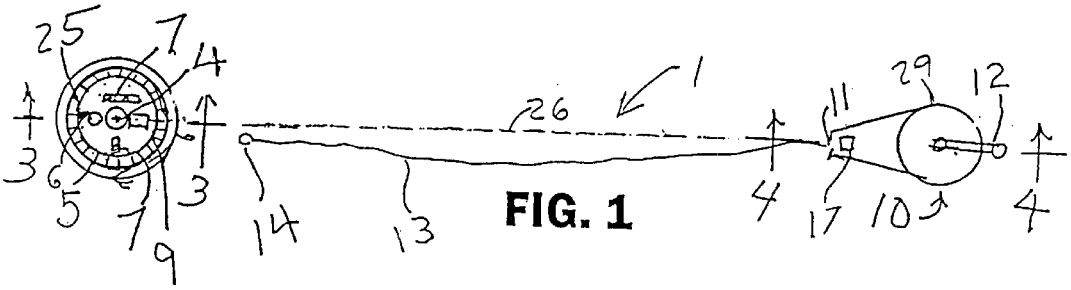
FIG. 1
FIG. 2
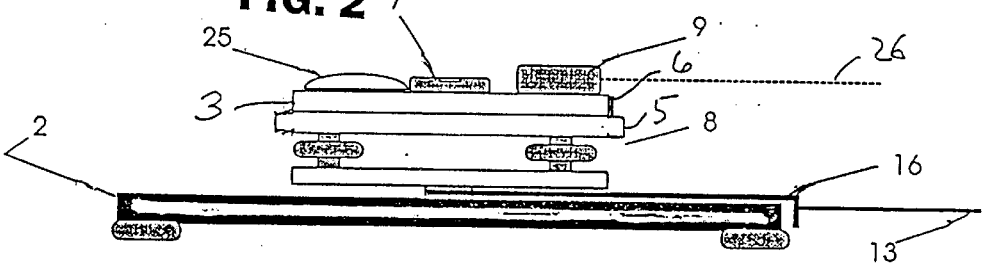
FIG. 3
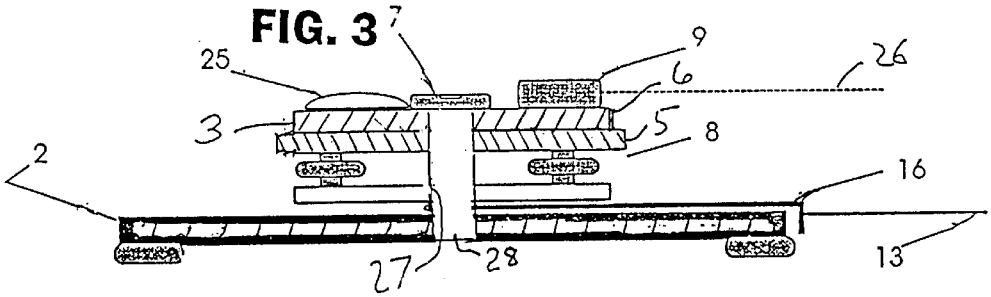
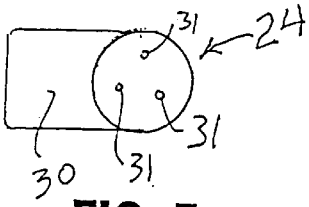
FIG. 5
FIG.4
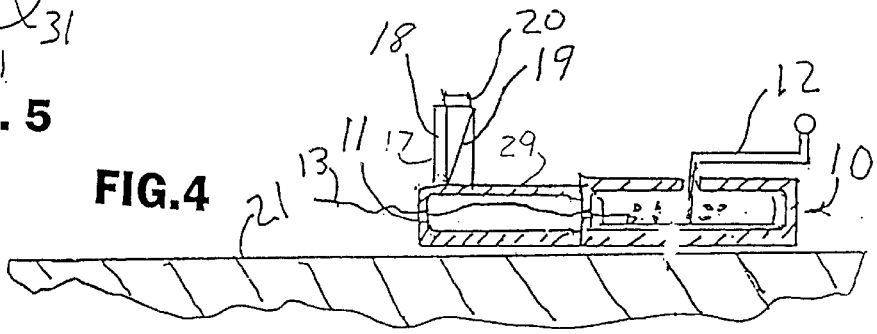

LASER GUIDED CHALK LINE APPARATUS

This invention relates to apparatus for accurate placement of a chalk line, and more particularly to a chalk line and laser assembly that provides a means for precise positioning of a chalk line that can be applied by a single operator.

BACKGROUND OF THE INVENTION

Lasers have become very useful to surveyors. They generally employ a laser emitter at one point that can be accurately positioned by a first operator and a receiver positioned by a second operator at a second point located to intercept the beam. In construction and related industry, it is common practice to mark a line on a surface with a chalk line. It would be useful to be able to position that line very accurately with the aid of a laser, especially if a single operator could use it..

SUMMARY OF THE INVENTION

It is accordingly an object of the invention to provide a laser chalk line assembly that is operable by a single person that would enable the chalk line to be positioned with great accuracy. It is another object that the apparatus be easy to use and inexpensive to produce. The apparatus of the invention comprises a laser pivotally mounted on a base. The laser may be adjusted to be level and rotated about a pivot to a preset angle relative to the base. A special chalk line reel has a chalk cord whose free end is removably attached to the base. The reel has a laser target that enables the operator to position the cord and reel in line with the light beam. The operator then snaps the cord onto the surface to be marked.

These and other objects, features, and advantages of the invention will become more apparent when the detailed description is studied in conjunction with the drawings in which like elements are designated by like reference characters in the various drawing figures.

BRIEF DESCRIPTION OF THE DRAWINGS

FIG. 1 is a top view of the laser chalk line apparatus of the invention.

FIG. 2 is a side view of the invention.

FIG. 3 is a cross sectional view taken through line 3—3 of FIG. 1.

FIG. 4 is a cross sectional view taken through line 4—4 of FIG. 1.

FIG. 5 is a top view of a stabilizing anchor for the base.

DETAILED DESCRIPTION OF PREFERRED EMBODIMENTS

Figure 6:
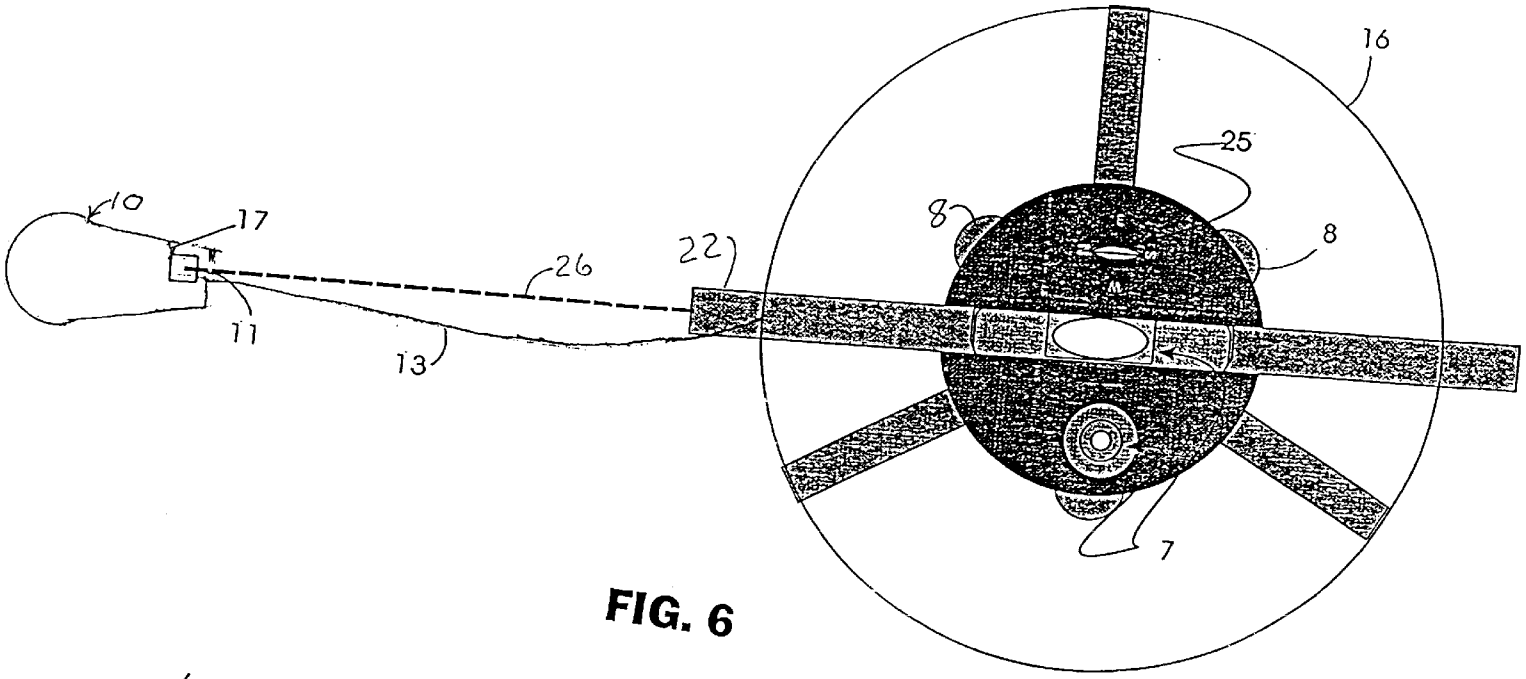
FIG. 6 is a top view of another embodiment of the invention.

Referring now to the drawing FIGS. 1–5, apparatus 1 for marking a line on a surface 21 includes a base 2 supporting a graduated circle 5. A laser support 3 is pivotally mounted on the base above the graduated circle 5 to rotate about a cylinder 27 having a reticle 28 at its transparent bottom so that the center of rotation 4 of the laser support may be positioned over a mark. A low power laser 9 is mounted on the support 3 to emit a radial beam 26 past an index point 6 on the support that will extend along a line from the mark. When it is desired to produce a chalk mark extending at a particular angle from a point on another line, the reticle is positioned over the point with the base rotated until the zero angle mark on the graduated circle is on the line. The laser may be leveled using the leveling screws 8 and the bubble levels 7. The laser support is then rotated until the index 6 on the laser support is at the desired angle on the graduated circle 5. The laser beam is now extending in the desired direction.

A chalk cord reel 10 has a chalk cord 13, within a reel housing 29 controlled by a reel crank 12 in a manner well known in the art. A free end 14 of the cord extends from the housing exit 11. The free end 14 is provided with a connection for removable attachment to an attachment means 16 that is rotatably mounted on the base 2. A target element 17 is mounted on the reel housing at the reel exit 11. The target element may fold down or telescope down when not in use. The target element is adapted for reception of the laser beam and for indicating that reception to an operator who is attempting to position the reel exit and the chalk cord along the beam. When the reel exit is correctly positioned, the operator can then tighten the cord, and snap it down on the surface to be marked with the chalk line.

Because the base may move when the cord is tightened and there is no second operator to hold the base steady, a stabilizing anchor element 24 such as that shown in FIG. 5 may be provided. It has recesses 31 to receive feet of the base, and a plate 30 on which to place a heavy object such as a concrete block or water can.

A compass 25 may be mounted on the support 3 so that the device may be used to mark a line along a particular compass direction.

The target element may take a variety of forms. In the embodiment best seen in FIG. 4, an elongate diagonal mirror 19 reflects the horizontal beam entering at any level vertically to an operator standing above it. To make the device more selective by eliminating other light, and to avoid danger from the laser beam, a filter 18 may pass only the laser light, and photosensor and emitter element 20 may be actuated by the laser light to emit a different light.

Figure 7:
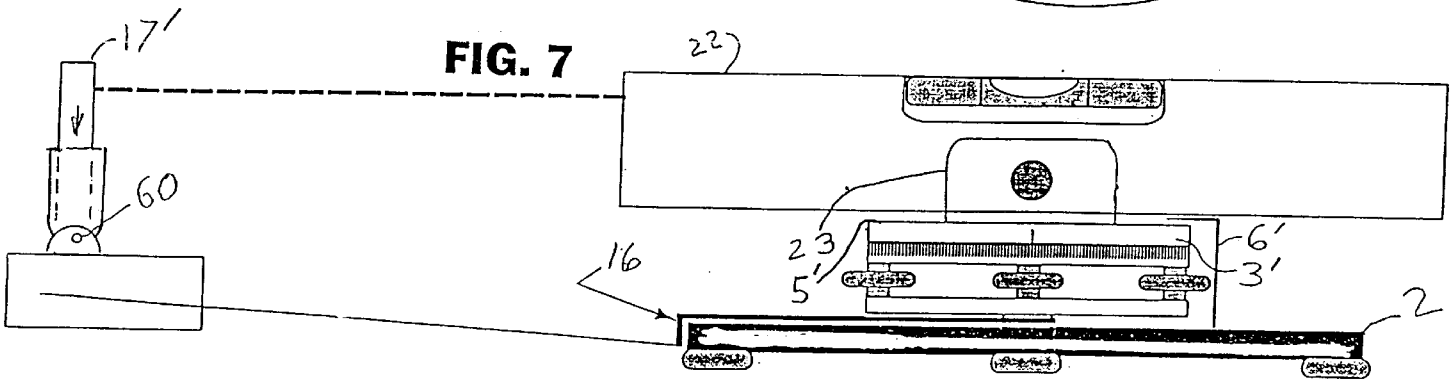
FIG. 7 is a side view of the apparatus of FIG. 6.

Referring now to the drawing FIGS. 6 and 7, another embodiment of the invention is shown in which the device makes use of a laser level 22 well known in the art to provide the laser beam. The laser level 22 is clamped onto the laser support plate 3' by clamp 23. In this embodiment, the graduated circle 5' is on the laser support plate and the index 6' is on the base.

The target 17' may be folded down at hinge 60 and/or telescoped down as shown in FIG. 7 for storage and transport.

While I have shown and described the preferred embodiments of my invention, it will be understood that the invention may be embodied otherwise than as herein specifically illustrated or described, and that certain changes in form and arrangement of parts and manner of practicing the invention may be made within the underlying idea or principles of the invention.

What is claimed is:

1. Apparatus for marking a line on a surface comprising:

a) a base supporting a graduated circle;

b) a laser support pivotally mounted on the base for rotation about a pivot point with an index on the laser support cooperating with the graduated circle to indicate angular position of the laser support relative to the base;

c) a laser emitter on the laser support aligned with the index to indicate angular position of a light beam emitted from the laser emitter relative to the base to enable the light beam to be directed along a preset direction;

d) leveling means for indicating and adjusting the laser emitter to a level condition;

e) a chalk cord reel having a chalk cord with a captive end connected to a crank and a free end passing out of the reel at a reel exit;

f) attachment means on the base for removably attaching thereto the free end of the chalk cord; and g) a target element on the reel for reception of the light beam and for indicating that reception to an operator to facilitate the operator's positioning of the reel exit in line with the beam, whereby the chalk cord can be connected from the base to the reel and aligned with the beam at a preset direction to enable the cord to be snapped onto a surface to produce a line on the surface with that preset direction.

2. The apparatus according to claim 1 further comprising a compass on one of the base or the laser support to indicate orientation of the apparatus.

3. The apparatus according to claim 1 further comprising reticle means at the pivot point.

4. The apparatus according to claim 1 in which the target element comprises a filter adapted to selectively pass the light emitted by the laser emitter to reduce the influence of ambient light.

5. The apparatus according to claim 4 in which the target element further comprises an elongate mirror to direct light vertically that has passed through the filter.

6. The apparatus according to claim 4 in which the target element further comprises a photosensitive element responsive to light passing through the filter.

7. The apparatus according to claim 1 in which the target element folds down when not in use.

8. The apparatus according to claim 1 in which the target element telescopes down when not in use.

9. Apparatus for marking a line on a surface comprising:

a) a base;

b) a laser support pivotally mounted on the base for rotation about a pivot point;

c) a graduated circle on one of the base or the laser support d) an index on the other of the base or the laser support, the index and the graduated circle cooperating with one another to indicate position of the laser support relative to the base;

e) a laser emitter on the laser support disposed to indicate angular position of a light beam emitted from the laser emitter relative to the base to enable the light beam to be directed along a preset direction;

f) a chalk cord reel having a chalk cord with a captive end connected to a crank and a free end passing out of the reel at a reel exit;

g) attachment means on the base for removably attaching thereto the free end of the chalk cord; and h) a target element on the reel for reception of the light beam and for indicating that reception to an operator to facilitate the operator's positioning of the reel exit in line with the beam, whereby the chalk cord can be connected from the base to the reel and aligned with the beam at a preset direction to enable the cord to be snapped onto a surface to produce a line on the surface with that preset direction.

10. The apparatus according to claim 9 further comprising leveling means for indicating and adjusting the light beam to a level condition.

11. The apparatus according to claim 9 further comprising a compass on one of the base or the laser support to indicate orientation of the apparatus.

12. The apparatus according to claim 9 further comprising reticle means at the pivot point.

13. The apparatus according to claim 9 in which the target element comprises a filter adapted to selectively pass the light emitted by the laser emitter to reduce the influence of ambient light.

14. The apparatus according to claim 13 in which the target element further comprises an elongate mirror to direct light vertically that has passed through the filter.

15. The apparatus according to claim 13 in which the target element further comprises a photosensitive element responsive to light passing through the filter.

16. The apparatus according to claim 10 in which the laser emitter and level indicating means are contained in a detachable level.

17. The apparatus according to claim 9 further comprising a stabilizing element on the base.

18. The apparatus according to claim 9 in which the target element folds down when not in use.

19. The apparatus according to claim 9 in which the target element telescopes down when not in use.

* * * * *